United States Patent [19]

Caruso

[11] 4,104,177

[45] Aug. 1, 1978

[54] GREASE COMPOSITIONS

[75] Inventor: Gerard P. Caruso, New Orleans, La.

[73] Assignee: Shell Oil Company, Houston, Tex.

[21] Appl. No.: 839,071

[22] Filed: Oct. 3, 1977

Related U.S. Application Data

[63] Continuation of Ser. No. 751,413, Dec. 16, 1976, abandoned.

[51] Int. Cl.[2] ..... C10M 1/32; C10M 3/26; C10M 5/20; C10M 7/30

[52] U.S. Cl. ..... 252/51.5 A; 252/392

[58] Field of Search ..... 252/51.5 A, 392

[56] References Cited

U.S. PATENT DOCUMENTS

| | | | |
|---|---|---|---|
| 3,296,133 | 1/1967 | Ratner et al. | 252/51.5 A |
| 3,778,372 | 12/1963 | Murphy | 252/51.5 A |
| 3,868,329 | 2/1975 | Brown et al. | 252/51.5 A |
| 3,997,469 | 12/1976 | Howle | 252/51.5 A |
| 3,997,698 | 12/1976 | Lamberti | 252/51.5 A |

*Primary Examiner*—Delbert E. Gantz
*Assistant Examiner*—Irving Vaughn

[57] ABSTRACT

Grease compositions containing a polyurea grease thickener and certain acylated alkylene polyamines are disclosed.

6 Claims, No Drawings

GREASE COMPOSITIONS

This is a continuation of application Ser. No. 751,413, filed Dec. 16, 1976 and now abandoned.

BACKGROUND OF THE INVENTION

The requirement that grease compositions provide adequate lubrication at high temperature for extended periods of time has become increasingly important. For this reason, grease compositions containing a variety of organic thickening agents, such as those containing multiple uriedo or urea functional groups, have been developed. For example, U.S. Pat. Nos. 3,242,210; 3,243,372 and 3,401,027 disclose polyurea grease thickeners obtained by reacting a three component reactant mixture comprising a monoamine, a diamine and a diisocyanate, or a monoisocyanate, a diisocyanate and a diamine. As a general rule, the reaction product is comprised of a mixture of urea-containing species of varying chain length and urea content. However, by careful control of reaction variables such as, e.g., the relative quantities of reactants employed, the reaction temperature and the rate and order of reactant mixing, a product may normally be obtained which predominates in one polyurea species. The polyurea reaction is preferably carried out in situ in the grease carrier, and the reaction product may be utilized directly as a grease thickener.

While greases thickened with polyurea thickeners are in many respects superior to older lubricants in severe service application, especially with regard to maintenance of grease consistency at high temperatures, such greases suffer several disadvantages which limit their usefulness under practical service conditions. For example, while polyurea thickened greases show excellent retention of mechanical properties at high temperature (70° C or above) and high or low shear, they tend to soften considerably when subjected to low shear at ambient temperature ranges (20° -30° C). In fact, the tendency to soften at ambient temperature under low shear can be so great that the grease can, when subject to mechanical working under these conditions, undergo a change in penetration grade, e.g., from a No. 2 NLGI penetration grade to a No. 1 NLGI penetration grade. This change in penetration grade at ambient temperature under low shear is particularly troublesome since it may occur under practical use conditions when the grease is transferred from the original shipping container or is otherwise stirred or handled. Consequently, normal handling of the grease in making it available to the ultimate consumer may change its consistency to such extent that it is no longer the desired penetration grade for the intended application. While it is true that the change in consistency is reversible, in that the softened grease can be subjected to high shear at high temperatures (conditions used in the original grease preparation) to return the grease to its original consistency, this reversal often requires that the softened grease be shipped back to the formulator for reprocessing.

Additionally, neat polyurea thickened greases demonstrate poor ability to inhibit rust formation, especially where lubricant service is required in corrosive environments. While additives have been proposed to overcome this problem, many conventional rust inhibitors adversely effect other desirable grease properties. For example, some additives cause the grease to soften, or function only as rust inhibitors (U.S. Pat. No. 3,868,329), thereby necessitating the use of other additives for a fully formulated grease package.

Accordingly, a need has existed for the development of a polyurea grease formulation containing a multipurpose additive which enhances the mechanical and chemical properties of the formulated grease product. The invention satisfied that need, and provides improved polyurea grease compositions containing a multifunctional additive effective in enhancing certain mechanical and chemical properties of the grease composition.

SUMMARY OF THE INVENTION

More particularly, the invention relates to polyurea thickened grease compositions having both improved ambient temperature mechanical stability and enhanced resistance against rust formation. These compositions comprise or consist essentially of a major amount of a lubricating oil base vehicle, a polyurea gellant in an amount sufficient to thicken the base vehicle to a grease consistency and a minor amount of a specified acylated alkylene polyamine or a mixture of specified acylated alkylene polyamines. The acylated alkylene polyamines employed have the formula

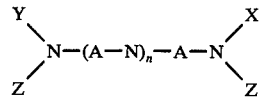

wherein A is alkylene of 2 to 4 carbon atoms and $n$ is an integer of from 0 to 3, X is H or Z, Y is selected from H, alkyl containing 12 through 22 carbon atoms, and Z, and Z is an acyl group selected from alkanoyl containing 2 through 22 carbon atoms, hydroxyalkanoyl containing 2 through 22 carbon atoms, alkenoyl containing 2 through 22 carbon atoms, hydroxyalkenoyl containing 2 through 22 carbon atoms, hexahydrobenzoyl, and cycloalkylalkanoyl containing 5 through 28 carbon atoms. Preferred acylated polyamines are those wherein Z is selected from alkanoyl containing 6 through 22 carbon atoms, hydroxyalkanoyl containing 6 through 22 carbon atoms, alkenoyl containing 6 through 22 carbon atoms, hydroxyalkenoyl containing 6 through 22 carbon atoms, hexahydrobenzoyl, and cycloalkylalkanoyl containing 6 through 23 carbon atoms.

The compositions of the invention exhibit several advantages. As indicated, they provide improved ambient temperature mechanical stability and improved rust protection. Additionally, the acylated polyamine additives increase the efficiency of the polyurea grease thickener so that less thickener is required to thicken the lubricating oil base vehicle to given penetration grade. The increase in grease yield based on the quantity of polyurea thickener employed has the secondary advantage of improving the low temperature properties of the grease because of the reduction in gellant content and concomitant increase in oil content. Other advantages accrue in that the multipurpose acylated polyamine additives of the compositions of the invention appear to act as bridging solvents in the polyurea thickened grease formulations, thereby reducing the opacity of the finished grease formulation. Again, the compositions are easily prepared. Where the acylated polyamine additive is added to the other components during preparation of the polyurea grease at a point prior to the conventional high pressure homogenization of the grease, the acylated polyamine appears to act as a highly effective dispersant, allowing production of a smooth grease without going through the costly homogenization step. Finally, the grease compositions of the invention are completely ashless.

DETAILED DESCRIPTION OF THE INVENTION

The acylated alkylene polyamines employed as multifunctional additives in the polyurea thickened grease compositions of the invention, broadly speaking, are oil-soluble amines which contain at least two acyl groups per molecule. More particularly, suitable acylated alkylene polyamines may be derived from an alkylene polyamine of the formula

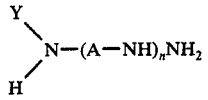

wherein A is alkylene of 2 to 4 carbon atoms, Y is H or alkyl containing, 2 through 22 carbon atoms and *n* is an integer of from 0 to 3. Preferred alkylene amines suitable for preparing the polyamides employed in the instant invention are alkylene amines wherein the alkylene unit, A, comprises 2 to 3 carbon atoms, and the number of alkylene amine units, *n*, is an integer from 1-3. The additives may be produced by reaction with an organic carboxylic acid which produce the acyl group, Z, as indicated, and preferably with those alkanoic acids containing 6 through 22 carbon atoms, hydroxyalkenoic acids containing 6 through 22 carbon atoms, hexahydrobenzoic acid, and cycloalkylalkanoic acids containing 6 through 23 carbon atoms, and mixtures thereof. The multifunctional additive may be present as a single derivative of the reaction between an amine and an acid, a derivative of the reaction of an amine and more than one acid, a derivative of a mixture of amines and an acid, or a derivative of the reaction between mixed amines and mixed acids, all of the types described.

Preferred amides include ethylene diamine, propylene diamine, tallow propylene diamine, diethylene triamine, and triethylene tetramine. Particularly preferred acids include caproic acid, lauric acid, 2-ethylhexanoic acid, oleic acid, tall oil fatty acid, stearic acid, linoleic acid, 2-methylpentanoic acid, ricinoleic acid, naphthenic acid, and cyclopentylacetic acid.

The acylated polyamide additives of the instant invention may be prepared by mixing one or more of the above described alkylene amines together with one or more of the acids at atmospheric pressure or greater, while simultaneously applying heat to the mixture. Generally, temperatures of from about 75° to about 190° C are satisfactory, with a temperature of from about 85° to about 95° C being preferred. The reactants are supplied generally in ratios of amine to acid of from 1 to 2, to 1 to 6, preferably in ratios of from 1 to 2, to 1 to 4. Heating is continued until the reaction is essentially complete, as evidenced by cessation of water evolution from the reaction mixture.

Suitable amides prepared by acylating an alkylene amine and polyamine with a hydrocarbyl caboxylic acid include those prepared using tall or fatty acid and oleic acid. Particularly preferred polyamides are tallow -1, 3-propylenediamine dioleate, and 1,3-propylene diamine dinaphthenate.

The polyurea grease component suitable for use in combination with the multipurpose additive of the present invention may be prepared by conventional means. For example, U.S. Pat. No.3,242,210 describes the preparation of polyurea thickened greases suitable for use in the combination of the instant invention, and its disclosure is incorporated herein by reference.

In order to insure uniform corrosion-inhibiting effectiveness and uniform hardening effect, the acylated alkylene polyamines are preferably combined with the polyurea grease after the polyurea forming reaction between the monoamine, isocyanate or diisocyanate, and diamine is complete. Addition at such a time avoids side reactions of the isocyanates in the reaction mixture with the amine functions of the additives. The additives may be incorporated at any time after the grease is thickened. For example, the additive may be supplied immediately after the polyurea reaction to enable use of a single mixing vessel, or the additive may also be added to previously prepared base greases. These base greases may include other additives, e.g., extreme pressure additives, such as sulfurized fatty oil acids, and chlorinated paraffin waxes; antioxidant additives, such as phenylalphanaphthylamine and diisooctyldiphenylamine; copper anticorrosion additives, such as 3-amino 1,2,4-triazole; and pour point depressants such as methacrylate polymers.

The effective amount or necessary concentration of the acylated polyamide additives in the polyurea grease will depend to some extent upon wich of the multipurpose properties, e.g., rust inhibition, low temperature, low shear stabilization, clarity improvement or gellant efficiency, is desired most in a given application. For general use, the acylated polyamides may be employed in concentrations of from about 0.5 percent to about 10 percent, by weight, based on the weight of the formulated grease, with from about 2 percent to about 10 percent by weight being preferred.

In order to demonstrate the invention more fully, reference is made to the following examples.

EXAMPLE I

A polyurea thickened base grease was prepared from the following components:

| BASE POLYUREA GREASE FORMULA | |
|---|---|
| COMPONENTS | PERCENT |
| Toluene Diisocyanate | 4.10 |
| Tallow amine[1)] | 7.06 |
| Ethylene Diamine | 0.85 |
| 500 HVI Oil Blend | 86.99 |
| Diisooctyl diphenylamine[2)] | 0.50 |
| Phenyl- -naphthylamine | 0.50 |

[1)]Available under the tradename Armeen T from Armak Co.
[2)]Available under the tradename Vanalube 81

The above components were combined in the manner described in U.S. Pat. No. 3,242,210 and, except where indicated, the gel formation reaction was allowed to go to completion before the inclusion of the acylated polyamine additive. The alkylene amines and a carboxylic acids of the class described were combined in separate containers and heated at about 190° C until water no longer evolved from the given reaction mixture. The particular acylated alkylene amine was then added to the gelled grease, and the mixture was stirred and heated at about 88° C until the additive was uniformly incorporated. The corrosion resistance of the acylated polyamide containing greases were then tested using the modified ASTM D1743 corrosion test, described as Test B in U.S. Pat. No. 3,660,288. For this test, results are indicated by a rating, ranging from 1 to 3, reported for the compositions effect with three bearings. A grade of 1 indicates no corrosion, while a rating of 2 indicates incipient corrosion with no more than three spots of size just sufficient to be visible to the naked eye. A bearing with larger or more than three spots is rated 3. In this test, in all instances, the polyamide additive comprised 4 percent by weight of the grease tested. Results of the tests are shown in Table 1.

TABLE I

| Additive - Amine/Carboxylic Acid | Molar Proportion | ASTM Corrosion |
|---|---|---|
| A. Tallow Propylene diamine/oleic acid | 1:2 | 1,1,1 |
| B. Tallow propylene diamine/naphthenic acid | 1:2 | 1,1,1 |
| C. Tallow Propylene diamine/ricinoleic acid | 1:2 | 1,1,1 |
| D. Triethylene tetramine/oleic acid | 1:6 | 1,1,3 |
| E. Triethylene tetramine/ricinoleic acid | 1:6 | 1,1,1 |
| F. Tallow propylene diamine/oleic acid[1)] | 1:2 | 1,1,1 |
| G. Tallow propylene diamine/oleic acid[2)] | 1:2 | 1,1,1 |
| H. Base Grease - No polyamide | — | Fail |

[1)]Amide added before tetraurea reaction complete
[2)]Amide added after tetraurea reaction complete As will be appreciated by those skilled in the art, the results in Table 1 demonstrate the effectiveness of the acylated polyamides of the instant invention as rust inhibitors. Experiments H and I demonstrate that the rust inhibition properties are not effected by the time of addition of the additives relative to the time of gel formation.

EXAMPLE II

Polyurea thickened greases of the formulation of Example I were tested for penetration to demonstrate the effect the instant acylated polyamides have upon grease gellant efficiency. The ASTM Unworked Penetration (Po) and the ASTM Worked Penetration ($P_{60}$) after 60 strokes in the ASTM worker, were determined.

TABLE 2

| Additive | Tetraurea Gellant Percent By Weight | Po | $P_{60}$ |
|---|---|---|---|
| 2A Base grease | 12 | 291 | 297 |
| 2B Tallow,-1 3-propylene diamine dioleate -4 percent by weight | 12 | 246 | 268 |
| 2C Tallow-1, 3-propylene diamine dioleate -4 percent by weight[(1)] | 10 | 300 | 345 |
| 2D Tallow -1, 3-propylene diamine dioleate -4 percent by weight[(2)] | 9.5 | 232 | 255 |

[1)]Polyamide added before grease structure formed
[2)]Polyamide added after grease structure formed Experiments 2A and 2B clearly demonstrate that less gellant is necessary to attain a given penetration with the acylated polyamide compositions of the invention. Experiments 2C and 2D demonstrate that in order to attain the greatest gellant efficiency, the polyamides should be added after grease formation is complete. The grease compositions containing the additives and less gellant were visibly clearer, and lacked the cloudiness of the base grease.

EXAMPLE III

This example demonstrates the improved stability of the compositions of the invention with regard to consistency when exposed to ambient temperature low shear. In this example, nine hundred sixty grams of polyurea grease with the same formulation as shown in Example I were placed in a ten quart Hobart bowl mixer which was modified to give 44 rpm with a planetary motion. Forty grams of tallow -1, 3-propylene diamine dioleate was added with stirring, with concomitant heating of the grease mixture to 82° C. The grease composition was then removed, cooled to 25° C and the ASTM worked and unworked penetrations were taken. The procedure was then repeated without the addition of the additive of the invention. Both grease compositions were then stirred in a modified Hobart mixer for 45 minutes at ambient temperature. This stirring technique is designed to simulate grease handling and transfer conditions which expose the grease to low rates of shear. The penetration results before and after exposure to low shear are shown in Table 3.

TABLE 3

| | 3A | 3B |
|---|---|---|
| Base Grease, percent by weight | 100 | 96 |
| Tallow -1, 3-propylene diamine dioleate, percent by weight | None | 4 |
| Original penetration of base grease, Po/$P_{60}$ | 306/306 | 306/306 |
| Penetration after stirring at ambient for 45 minutes, Po/$P_{60}$ | 365/323 | — |
| Penetration after stirring/heating to 82° C Po/$P_{60}$ | 297/279 | 220/252 |
| Ambient stirring 45 minutes, Po/$P_{60}$ | 350/313 | 273/273 |

Heat has partially improved the penetration of the base grease, but additional shear results in softening to the next NLGI grade (350/313). The additive, however, reduced the softening to where it remained in the No. 2 NLGI grade (273/273). The close correspondence and the Po and $P_{60}$ indicate the stabilizing effect of the additive. The unworked/worked penetration of 306/306 was a result of the original grease softening in handling from its original 265/295 No. 2 grade. This grease had been Gaulinized when originally made.

EXAMPLE IV

This example illustrates the improved gellant efficiency of the compositions of the invention. This characteristic is desirable, in that either less gellant will be required for a given formulation, or greases may be formulated to a given NLGI specification without requiring the use of high shear devices.

In this example, a polyurea grease of the composition used in Example 1 was made by a continuous method. It was not Gaulinized, but was processed through a mixing tube. This base grease shall be designated grease A. Other portions were treated, as indicated in Table 4, with results also recorded in the table.

TABLE 4

| | Po | $P_{60}$ |
|---|---|---|
| 4A Base grease A | 268 | 304 |
| 4B Base grease A, heated to 93° C for one-half hour | 265 | 302 |
| 4C Base grease A, Gaulinized at 5000 psi | 265 | 281 |
| 4D Base grease A, Gaulinized twice at 5000 psi | 249 | 271 |
| 4E Base grease A + 4 percent by weight Tallow -1, 3-propylene diamine dioleate, heated to 93° C and then cooled to ambient (not Gaulinized) | 215 | 255 |

Experiment 4E shows the grease yield in penetration has been improved by incorporating an additive, without the use of high shear devices.

EXAMPLE V

This example demonstrates further the low temperature shear stability of the compositions of the invention. The acylated alkylene polyamines as shown in Table 5, were added to the polyurea grease of Example V. The mixture was then stirred and heated to 88° C until uniform incorporation of the acylated polyamines into the grease was obtained. The unworked and worked penetrations were taken. Then the samples were subjected to low temperature, low shear by slow stirring at ambient temperature for 45 minutes, as above. The term "low shear", as employed herein, is that condition occurring during the agitation of the samples in the mixing vessel resulting from applied forces which causes two continuous elements of the compositions to slide relative to each other in a direction parallel to their plane of contact. In this example, the appropriate relative velocity used was 70 cm/sec. The following results were observed. Rust resistance was also determined.

TABLE 5

| EXPERIMENT | 5A | 5B | 5C | 5D |
|---|---|---|---|---|
| Additive | — | 1,3-propylene diamine dinaphthenate | ethylene diamine dioleate | Tallow -1,3 propylene diamine dioleate |
| Amount of Additive, percent by weight | None | 4 | 4 | 4 |
| Penetration after mixing in additive, $Po/P_{60}$ | 313/306 | 257/275 | 203/264 | 189/383 |
| 45 Minutes of ambient slow stirring, $Po/P_{60}$ | 364/325 | 310/306 | 338/331 | 276/282 |
| Modified ASTM D1743 Corrosion | Fail | 1,1,1 | 1,1,1 | 1,1,1 |

The stability of the compositions of the invention when subjected to ambient temperature low shear is demonstrated by only slight variation in unworked/-worked penetrations.

I claim as my invention:

1. A grease composition comprising of a major amount of a lubricating oil base vehicle, a polyurea gellant in an amount sufficient to thicken the base vehicle to a grease consistency and a minor amount of an acylated alkylene polyamine or mixture of acylated alkylene polyamines, the acylated alkylene polyamine or acylated alkylene polyamines having the formula

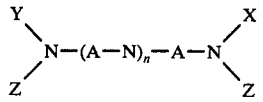

wherein A is alkylene of 2 to 4 carbon atoms and $n$ is an integer of from 0 to 3, X is H or Z, Y is selected from H, alkyl containing 12 through 22 carbon atoms, and Z, and Z is an acyl group selected from alkanoyl containing 2 to 22 carbon atoms, hydroxy alkanoyl containing 2 to 22 carbon atoms, alkenoyl containing 2 to 22 carbon atoms, hydroxyalkenoyl containing 2 to 22 carbon atoms, hexahydrobenzoyl, and cycloalkylalkanoyl containing 5 through 28 carbon atoms.

2. The grease composition of claim 1 wherein Z is alkanoyl containing 6 through 22 carbon atoms, hydroxyalkanoyl containing 6 through 22 carbon atoms, and hexahydrobenzoyl.

3. The composition of claim 1 wherein the acylated alkylene polyamine is 1,3-propylene diamine dinaphthenate.

4. The composition of claim 1 wherein the acylated alkylene polyamine is ethylene diamine dioleate.

5. The composition of claim 1 wherein the acylated akylene polyamine is tallow-1,3-propylene diamine dioleate.

6. The composition of claim 1 wherein the mixture of acylated alkylene polyamines contains at least two members selected from the group consistingof 1,3-propylene diamine dinaphthenate, ethylene diamine dioleate, and tallow-1,3-propylene diamine dioleate.

* * * * *